US006043019A

United States Patent [19]

Jagannathan et al.

[11] Patent Number: 6,043,019

[45] Date of Patent: Mar. 28, 2000

[54] ROBUST METHOD FOR THE PREPARATION OF HIGH BROMIDE TABULAR GRAIN EMULSIONS

[75] Inventors: Ramesh Jagannathan; Rajesh V. Mehta; Steven P. Szatynski, all of Rochester; Wai K. Lam, Webster, all of N.Y.

[73] Assignee: Eastman Kodak Company, Rochester, N.Y.

[21] Appl. No.: 09/218,691

[22] Filed: Dec. 22, 1998

[51] Int. Cl.[7] ..... G03C 1/015; G03C 1/035

[52] U.S. Cl. ..... 430/569; 430/567

[58] Field of Search ..... 430/569, 567

[56] References Cited

U.S. PATENT DOCUMENTS

| | | | |
|---|---|---|---|
| 4,433,048 | 2/1984 | Solberg et al. | 430/569 |
| 4,434,226 | 2/1984 | Wilgus et al. | 430/569 |
| 4,439,520 | 3/1984 | Kofron et al. | 430/569 |
| 5,549,879 | 8/1996 | Chow | 430/569 |
| 5,663,041 | 9/1997 | Chang et al. | 430/569 |
| 5,667,954 | 9/1997 | Irving et al. | 430/569 |

OTHER PUBLICATIONS

*Research Disclosure*, vol. 382, Feb. 1996, Item 38213.

*Primary Examiner*—Mark F. Huff
*Attorney, Agent, or Firm*—Andrew J. Anderson; Carl O. Thomas

[57] ABSTRACT

A method is disclosed of manufacturing a radiation-sensitive tabular grain emulsion comprised of (a) providing in a stirred reaction vessel a host tabular grain emulsion containing greater than 50 mole percent bromide, based on silver, and a speed enhancing amount of iodide and (b) then introducing a silver salt solution into the stirred reaction vessel, wherein (1) the silver salt solution is introduced into the stirred reaction vessel at a rate sufficient to create a new grain population, (2) halting introduction of the silver salt solution for a time sufficient to allow the new grain population to be ripened out, and (3) repeating steps (1) and (2) from 3 to 20 times until silver introduced in steps (1) and (2) amounts to from 5 to 50 percent of total silver forming the radiation-sensitive tabular grain emulsion.

10 Claims, 1 Drawing Sheet

ROBUST METHOD FOR THE PREPARATION OF HIGH BROMIDE TABULAR GRAIN EMULSIONS

FIELD OF THE INVENTION

The invention is directed to a process of preparing photographic emulsions. More specifically, the invention is directed to a process of preparing high bromide tabular grain emulsions.

DEFINITION OF TERMS

All references to silver halide grains and emulsions that contain two or more halides name the halides in order of ascending concentrations.

The terms "high chloride" and "high bromide" refer to silver halide grains and emulsions in which chloride and bromide, respectively, account for greater than 50 mole percent of total halide, based on silver.

The term "equivalent circular diameter" or "ECD" in referring to a silver halide grain indicates the diameter of a circle having an area equal to the projected area of the grain.

A "tabular" grain is one having two parallel crystal faces that are clearly larger than any other crystal face and in which the ratio of ECD to grain thickness (th), as referred as aspect ratio, is at least two.

A tabular grain emulsion is an emulsion in which tabular grains account for greater than 50 percent of total grain projected area.

The term "robust" refers to the ability of an emulsion to undergo variations in its preparation with relatively small, if any, variations in grain properties.

The term "speed" refers to the exposure required to produce a reference density in a photographic element. Speed differences are typically measured in units of log E, where E is exposure in lux-seconds, or relative speed, where each unit difference in relative speed amounts 0.01 log E. For example, relative speeds of 100 and 130 differ by 0.30 log E.

The term "photographic processing" denotes development and any subsequent aqueous bath treatments of a silver halide photographic element performed to obtain a stable, viewable image.

*Research Disclosure* is published by Kenneth Mason Publications, Ltd., Dudley House, 12 North St., Emsworth, Hampshire P010 7DQ, England.

BACKGROUND OF THE INVENTION

Figure 1:
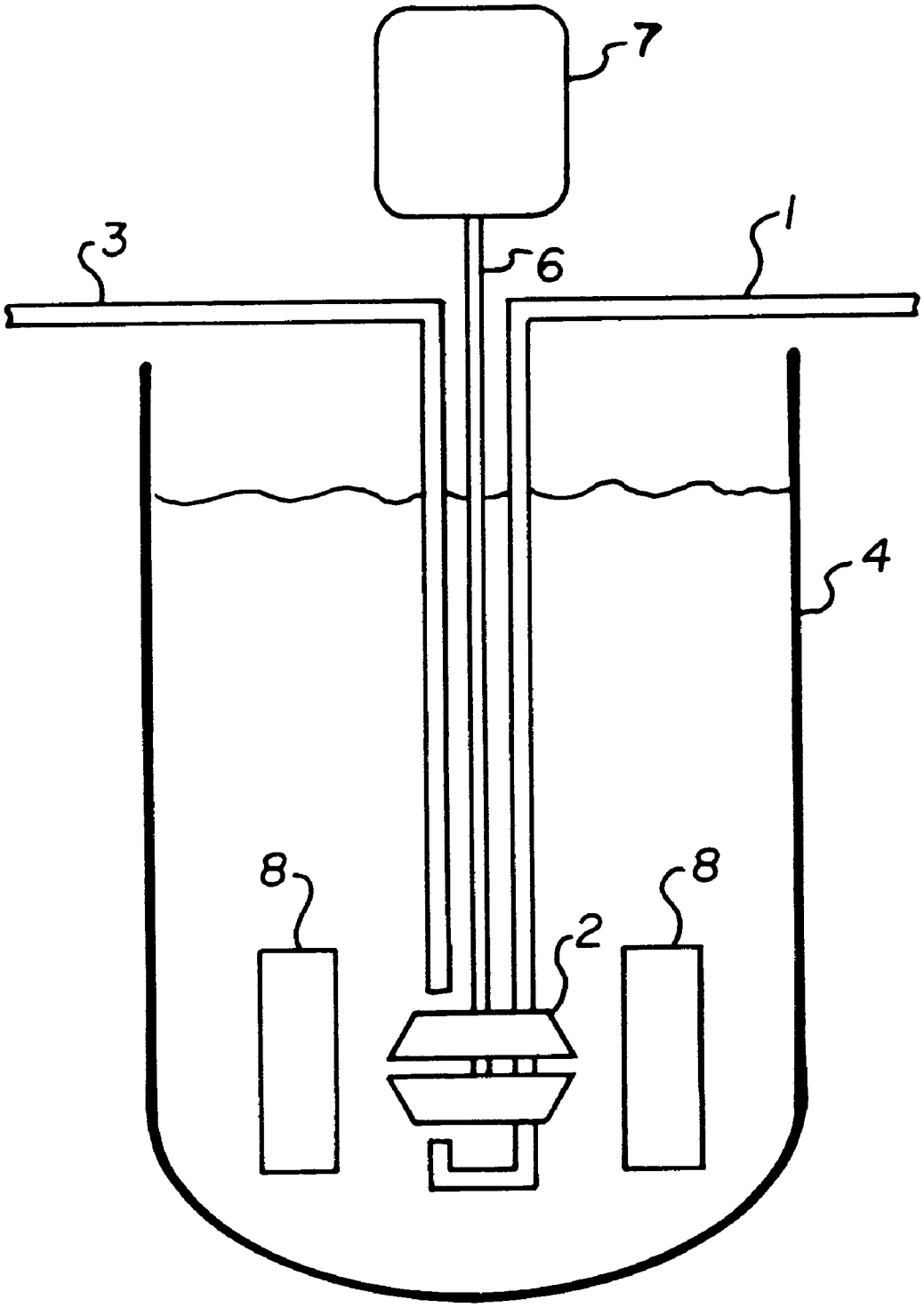
FIG. 1 is a partially schematic side elevation of a silver halide emulsion precipitation apparatus.

In its most commonly practiced form silver halide photography employs a film in a camera to produce, following photographic processing, a negative image on a transparent film support. A positive image for viewing is produced by exposing a photographic print element containing one or more silver halide emulsion layers coated on a reflective white support through the negative image in the camera film, followed by photographic processing.

Ideally a camera film should capture images under any set of conditions that allow a subject to be seen by the human eye. In practice restricted lighting and subject motion often require more speed in taking films than can be produced without significantly degrading image quality. A continuous effort has been exerted over more than a century to improve the speed-granularity characteristics in taking films.

For camera speed film the preferred radiation-sensitive silver halide emulsions are high bromide silver halide emulsions that contain minor amounts of iodide, based on silver. Iodide at levels as low as 0.01 (preferably at least 0.5) mole percent, based on silver, in high bromide emulsions increase imaging speed without increasing granularity. Although the mechanism by which iodide increases imaging speed has not been proven, it is generally believed that the iodide induced speed increases are related to the strains or dislocations placed on the face centered cubic crystal lattice structure of silver bromide by the lattice site inclusion of even small amounts of relatively larger iodide ions in place of bromide ions.

Iodide containing high bromide tabular grain emulsions offer the most desirable combination of imaging speed and image noise (granularity) characteristics. These emulsions were first described by Wilgus et al U.S. Pat. No. 4,434,226 and Kofron et al U.S. Pat. No. 4,439,520. Solberg et al U.S. Pat. No. 4,433,048 and Irving et al U.S. Pat. No. 5,667,954 are exemplary of teachings that non-uniform placement of iodide within high bromide tabular grains can increase imaging speed further without increasing granularity.

It is a common practice in preparing iodide containing high bromide silver halide emulsions to run a silver salt solution into the reaction vessel after iodide ion introduction has been completed without introducing additional halide salt solution--commonly referred to as a silver salt overrun. Since photographic silver halide emulsions are routinely precipitated with a stoichiometric excess of halide ion to avoid fog, the dispersing medium contains the stoichiometric excess of halide ions after silver ion has been depleted by precipitation. The remaining halide ion reacts with silver ion supplied during the silver salt overrun. During the silver salt overrun silver bromide is precipitated, since no significant amount of iodide ions is present in the stoichiometric excess of halide ions. Silver iodide exhibits a solubility approximately three orders of magnitude lower than that of silver bromide, resulting in iodide ions being disproportionately depleted from the stoichiometric excess of halide ions remaining in the dispersing medium before the silver salt overrun begins. When the silver salt overrun is followed by simultaneous introduction of silver and bromide salt solutions, one effect of the silver salt overrun is to lower the stoichiometric excess of bromide ion in the dispersing medium for the balance of the precipitation.

It is a common practice to precipitate silver halide emulsions using a double-jet precipitation technique in which a silver salt solution and halide salt solution are simultaneously added to a reaction vessel containing a dispersing medium. Chow U.S. Pat. No. 5,549,879 discloses a pulsed flow double jet technique for preparing silver halide grains. Referring to FIG. 1, Chow discloses introducing an aqueous silver nitrate solution from a remote source by a conduit 1 which terminates close to an adjacent inlet zone of a mixing device 2, which is disclosed in greater detail in Research Disclosure, Vol. 382, Feb. 1996, Item 38213. Simultaneously with the introduction of the aqueous silver nitrate solution and in an opposing direction, aqueous halide solution is introduced from a remote source by conduit 3, which terminates close to an adjacent inlet zone of the mixing device 2. The mixing device is vertically disposed in vessel 4 and attached to the end of shaft 6, driven at high speed by any suitable means, such as motor 7. The lower end of the rotating mixing device is spaced up from the bottom of the vessel 4, but beneath the surface of the aqueous silver halide emulsion contained within the vessel. Baffles 8, sufficient in number of inhibit horizontal rotation of the contents of vessel 4 are located around the mixing device.

Chow teaches operating the apparatus of FIG. 1 in the following manner: (a) providing an aqueous solution containing silver halide particles having a first grain size; (b) continuously mixing the aqueous solution containing silver halide particles; (c) simultaneously introducing a soluble silver salt solution and a soluble halide salt solution into a reaction vessel of high velocity turbulent flow confined within the aqueous solution for a time t, wherein high is at least 1000 rpm; (d) simultaneously halting the introduction of the soluble silver salt solution and the soluble halide salt solution into the reaction for a time T wherein T>t, thereby allowing the silver halide particles to grow; and (e) repeating steps (c) and (d) until the silver halide particles attain a second grain size greater than the first grain size.

Chow teaches the pulse flow technique to permit easier scalability of the precipitation method. The Examples of Chow are restricted to the preparation of high chloride silver halide emulsions. Chow does not mention iodide containing high bromide emulsions and makes no mention of tabular grain emulsions. In addition, Chow applies its pulse flow technique to the precipitation as a whole, rather than any particular portion of an overall precipitation.

SUMMARY OF THE INVENTION

In one aspect, this invention is directed to a method of manufacturing a radiation-sensitive tabular grain emulsion comprised of (a) providing in a stirred reaction vessel a host tabular grain emulsion containing greater than 50 mole percent bromide, based on silver, and a speed enhancing amount of iodide and (b) then precipitating silver bromide onto grains of the host tabular grain emulsion, wherein, in step (b), (1) introducing a silver salt solution into the dispersing medium at a rate sufficient to create a new grain population, (2) halting introduction of the silver salt solution for a time sufficient to allow the new grain population to be dissolved by ripening with silver and bromide ions released from the new grain population being precipitated onto the grains of the host tabular grain emulsion, and (3) repeating steps (1) and (2) from 3 to 20 times until silver bromide deposited onto the grains of the host tabular grain emulsion amounts to from 5 to 50 percent of total silver forming the radiation-sensitive tabular grain emulsion.

It has been discovered quite surprisingly that the method of the invention produces iodide containing high bromide tabular grain emulsions that are more robust when chemically sensitized at varied temperatures. That is, variations in chemical sensitization temperatures produce smaller variations in imaging speed than in a comparable emulsion in which the silver salt overrun is continuous.

In addition, improvements in speed-granularity relationships have been observed.

Finally, the method of the invention produces iodide containing high bromide tabular grain emulsions that exhibit reduced intrinsic fog. Intrinsic fog is a measure of $Ag^{\circ}$ clusters within the crystal lattice that are not developable in the emulsion as initially precipitated, but are promoted by gold sensitization (also referred to as gold latensification) to a developable state. By reducing intrinsic fog, the minimum densities of gold sensitized emulsions are reduced. This invention also reduces the batch to batch variability of minimum density attributable to the presence of intrinsic fog.

DETAILED DESCRIPTION OF THE INVENTION

The method of the invention can be viewed as a modification of any conventional method for preparing iodide containing high bromide tabular grain emulsions. Precipitation, usually in a double jet reactor of the general type shown in FIG. 1 and described above, can be conducted by conventional techniques until from 50 to 95 percent of total silver forming the emulsion has been precipitated. Usually the silver nitrate salt solution is introduced through conduit 3 while the halide salt solution is introduced through conduit 1. This produces an iodide containing high bromide tabular grain emulsion that acts as a host tabular grain emulsion for precipitation of additional silver halide.

The teachings of the following patents, here incorporated by reference, are contemplated for preparing iodide containing high bromide host tabular grain emulsions:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Black et al U.S. Pat. No. 5,219,720;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840;
Delton U.S. Pat. No. 5,372,927;
Maskasky U.S. Pat. No. 5,411,851;
Maskasky U.S. Pat. No. 5,411,853;
Maskasky U.S. Pat. No. 5,418,125;

Delton U.S. Pat. No. 5,460,934;

Fenton et al U.S. Pat. No. 5,476,760;

Daubendiek et al U.S. Pat. No. 5,494,798;

Olm et al U.S. Pat. No. 5,503,970;

Daubendiek et al U.S. Pat. No. 5,503,971;

Daubendiek et al U.S. Pat. No. 5,573,902;

Daubendiek et al U.S. Pat. No. 5,576,168;

Olm et al U.S. Pat. No. 5,576,171;

Deaton et al U.S. Pat. No. 5,582,965;

Maskasky U.S. Pat. No. 5,604,085;

Reed et al U.S. Pat. No. 5,604,086;

Eshelman et al U.S. Pat. No. 5,612,176;

Levy et al U.S. Pat. No. 5,612,177;

Wilson et al U.S. Pat. No. 5,614,358;

Eshelman et al U.S. Pat. No. 5,614,359; and

Maskasky U.S. Pat. No. 5,620,840.

The host tabular grain emulsions prepared by the teachings of these patents can have either uniform or non-uniform iodide distributions. In those teachings in which a maximum iodide concentration is confined to a restricted region of the grains, followed by the precipitation of at least 5 percent of total silver, it is preferred that the host tabular grain emulsion preparation follow the patent teaching through the completion of iodide ion precipitation in the maximum iodide concentration restricted region, omitting only subsequent precipitation. Alternately, particularly where the disclosed silver salt overrun does not constitute at least 5 percent of total silver, the proportion of silver introduced prior to introducing a maximum iodide ion concentration can be reduced to accommodate subsequent deposition of silver bromide amounting to at least 5 percent of total silver. Where iodide ion is uniformly distributed in the host tabular grains, the proportion of total silver employed in the host tabular grains can easily be adjusted to any value within the range of from 50 to 95 percent. It is preferred that the host tabular grains account for at least 70 percent of total silver forming the emulsions produced by the invention.

Into a stirred reactor containing the host tabular grain emulsion, the final 5 to 50 (preferably 30) percent of the silver forming the final tabular grain emulsion is introduced in the following manner:

(1) A silver salt solution is introduced into the dispersing medium at a rate sufficient to create a new grain population.

(2) Introduction of the silver salt solution is halted for a time sufficient to allow the new grain population to be dissolved by ripening, with silver and bromide ions released from the new grain population being precipitated onto the grains of the host tabular grain emulsion.

(3) Steps (1) and (2) are repeated from 3 to 20 times until silver bromide deposited onto the grains of the host tabular grain emulsion amounts to from 5 to 50 percent of total silver forming the final tabular grain emulsion.

The silver salt solution can be introduced alone as a silver salt overrun or, preferably, can be introduced simultaneously with a bromide salt solution. It is specifically contemplated to introduce a silver salt solution and a bromide salt solution simultaneously in combination with a prior silver salt overrun, a subsequent silver salt overrun, or both, where the function of the silver salt overrun is to adjust the stoichiometric excess of bromide ion in the dispersing medium to an optimum level. When no adjustment of the bromide ion stoichiometric excess is sought, no silver salt overrun is required.

As is well understood in the art, new grain formation (commonly referred to as renucleation and avoided in most precipitations) occurs when the rate of precipitation exceeds the rate at which precipitation onto existing grain surfaces can be accommodated. The object in Step (1) is to produce a new grain population by introducing silver salt solution and bromide salt solution (where simultaneously introduced) as rapidly as possible. Thus, the silver salt solution and the bromide salt solution, where employed) are simultaneously introduced in a short pulse. The duration of the pulse is significantly less than 1 minute, typically from 5 to 45 seconds. The minimum time is limited only by the capability of rapidly introducing the silver and bromide salt solutions. A pulse of about 10 to 25 seconds is usually convenient.

Since the next step is to dissolve the new grain population, it serves no purpose to continue silver and bromide salt solution introductions longer than a convenient pulse length needed to create a fine grain population. It is generally preferred that the fine grains have an average ECD that is less than about 0.1 $\mu$m.

The object of Step (2) is to dissolve the fine grain population created in Step (1). In this step the silver and bromide ions that precipitated to form the fine grains reenter the dispersing medium, resulting in the fine grains being dissolved. As the silver and bromide ions reenter the dispersing medium, they are precipitated onto the grains of the host tabular grain emulsion. Stirring during this step insures that the silver bromide deposition is well distributed among the grains of the host tabular grain emulsion.

The time T required to dissolve the new grain population is longer than the time t required to form the new grain population. Usually Step (2) requires at least 1 minute, and stirring without silver or bromide salt solution introductions of up to 20 minutes or more are feasible. Unnecessarily extended stirring increases the overall time required to a complete an emulsion make and is for that reason undesirable. A typical Step (2) interval T is from 3 to 15 minutes. The presence of ripening agent in the dispersing medium can relied upon to reduce the length of the interval T.

Upon the completion of Step (2), Steps (1) and (2) are repeated until the desired proportion of total silver has been precipitated onto the grains of the host tabular grain emulsion. The number or repetitions is a balance between keeping the average ECD's of the fine grains small and avoiding undesirably high repetitions of Steps (1) and (2) in sequence. A practical balance of from 3 to 20 repetitions of Steps (1) and (2) has been found to be convenient. Generally from 5 to 10 repetitions are preferred. Although the term "repetitions" is considered clear, to avoid any possible misinterpretation, it is noted that the repetitions are in addition to the initial performance of Steps (1) and (2).

The aqueous silver salt solution and the aqueous bromide solution introduced during Steps (1) and (2) can conform to any of the aqueous silver salt solutions and aqueous bromide salt solutions introductions used to form the host tabular grain emulsions, disclosed in the patents cited and incorporated by reference above. Since the host tabular grain emulsion already has a stoichiometric excess of bromide ion in the dispersing medium, in most instances it is contemplated to balance stoichiometrically the silver and bromide salt solutions that are simultaneously introduced in Step (1). However, as an alternative to employing a silver salt overrun, the relative proportions of silver and bromide salt solutions can be adjusted to rebalance the bromide ion excess in the dispersing medium within the reactor to any desired conventional level.

Silver and reference counter electrodes (not shown in FIG. 1) immersed in the dispersing medium are conventionally employed to monitor the stoichiometric excess of bromide ion. Since the composition of the dispersing medium remains homogeneous as a result of the introduction and mixing steps herein employed, any placement of the electrodes in the dispersing medium is feasible. The silver electrode voltage can be translated to pAg, and pAg can be converted to pBr using the equation:

$$pAg+pBr=-logKsp$$

where

Ksp is the solubility product constant of AgBr at the temperature of the dispersing medium and pAg and pBr are the negative logarithms of silver ion and bromide ion activity, respectively, in the dispersing medium.

pBr during Steps (1) and (2) can be selected to favor silver bromide precipitation onto the edges of the tabular grains or to provide a substantially uniform shell covering the major faces and edges of the tabular grains. Kofron et al U.S. Pat. No. 4,439,520 teaches maintaining pBr within the range of from 0.6 to 2.2 to favor deposition onto the edges of tabular grains. Kofron et al further teaches that raising pBr above 2.2 produces deposition onto the major faces of the tabular grains. Daubendiek et al U.S. Pat. No. 4,914,014 discloses selected conditions under which preferential growth onto the edges of tabular grains can be realized at pBr values greater than 2.3. To enhance the reduction of intrinsic fog, it is specifically contemplated to ripen out at least a portion of the new grain population onto the major faces of the tabular grains.

The overall average iodide concentration of the tabular grain emulsions produced by the method of the invention can range from the minimum level necessary to produce a speed increase attributable to iodide up to the maximum feasible level of iodide incorporation into the face centered cubic silver bromide crystal lattice structure. Maximum iodide ion incorporation is generally stated to be 40 mole percent, based on silver, but, in fact, iodide ion saturation varies, depending upon the conditions of incorporation. In practice overall iodide ion concentrations rarely exceed 20 mole percent, based on silver. Preferably overall iodide concentrations are in the range of from 0.5 to 10 mole percent, based on silver, with overall iodide concentrations of from 0.5 to 5 mole percent, based on silver being typical.

When iodide is introduced to form a maximum iodide concentration in a restricted region of the tabular grains, high iodide concentrations can be tolerated for short periods. It is, in fact, common to see silver iodide precipitated as a separate phase from the face centered cubic crystal lattice of the tabular grains, but in a short period the iodide is integrated into high bromide crystal lattice structure. The restricted region of maximum iodide concentration exhibits an iodide ion concentration that is at least 1 (typically at least 2) mole percent higher than iodide ion concentrations elsewhere the in tabular grains.

In all instances the tabular grain emulsions prepared by the method of the invention contain greater than 50 mole percent bromide, based on silver. Preferably the prepared tabular grain emulsions contain greater than 70 mole percent bromide, based on silver, and optimally greater than 90 mole percent bromide, based on silver. The balance of the halide not accounted for by bromide and iodide can be chloride. The Delton patents cited above disclose advantages for chloride inclusion. Chloride inclusions are preferably limited to up to 5 mole percent, based on silver.

Tabular grains account for greater than 50 percent of total grain projected are in the emulsions prepared by the method of the invention. Preferably the tabular grains account for greater than 70 percent and optimally greater than 90 percent of total grain projected area. Tabular grain emulsions in which tabular grains account for substantially all (>97%) of total grain projected area can be formed, as illustrated by the tabular grain emulsion patents cited above, including Antoniades et al U.S. Pat. No. 5,250,403 and Daubendiek et al U.S. Patents 5,503,971, 5,573,902 and 5,576,168.

The spectrally sensitized tabular grains satisfying the projected area requirements above are contemplated to have thicknesses of less than 0.3 Jim. To take advantage of the native absorption of blue light by iodide containing high bromide grains, the thicknesses of the tabular grains can be usefully increased to up to 0.5 $\mu$m for recording blue light exposures. The method of the invention can be employed to create ultrathin tabular grain emulsions in which in which the average thickness of the tabular grains is less than 0.07 $\mu$m.

The method of the invention can be employed to prepare iodide containing high bromide tabular grain emulsions of any conventional average ECD. An average ECD of 10 $\mu$m is often stated to be the maximum average ECD compatible with photographic utility, although a few demonstrations of higher average ECD tabular grain emulsions are known. In most instances average ECD's of the tabular grain emulsions are in the range of from 1 to 5 Jim.

The average aspect ratio (ECD/th) of the tabular grains are preferably at least 5 and most preferably greater than 8. Tabular grain average aspect ratios can range up to 100 or higher, but are typically less than 50.

The proportion of the total aqueous dispersing medium present in the reactor prior to silver halide precipitation amounts to at least 10 percent, by weight, of the total weight of the dispersing medium at the conclusion of precipitation. By conducting ultrafiltration during precipitation, as taught by Mignot U.S. Pat. No. 4,334,012, it is possible to maintain a constant volume of reactants in the reactor throughout the precipitation. Most precipitations are conducted with from 20 to 80 percent of the total aqueous dispersing medium in the reactor prior to silver halide precipitation.

During precipitation any convenient grain peptizer can be present. As taught by Mignot U.S. Pat. No. 4,334,012, no peptizer is required during grain nucleation and initial growth. However, typically at least 10 percent and preferably at least 20 percent of the total peptizer present in the emulsion at the conclusion of precipitation is present in the dispersing medium prior to initiating silver halide precipitation. It is contemplated that the emulsions at the conclusion of precipitation will contain from 5 to 50 (preferably 10 to 30) grams of peptizer, per mole of silver halide.

Conventional choices of peptizers are summarized in *Research Disclosure,* Item 38957, II. Vehicles, vehicle extenders, vehicle-like addenda and vehicle related addenda, A. Gelatin and hydrophilic colloid peptizers. Gelatin and gelatin derivatives, such as phthalated or acetylated, constitute preferred peptizers.

In addition to the essential constituents noted above, it is possible to introduce other substances into the dispersing medium in which the tabular grains are formed and grown for the purpose of modifying photographic performance, as illustrated by *Research Disclosure,* Item 38957, I. Emulsion grains and their preparation, D. Grain modifying conditions and adjustments. The inclusion of dopants at any stage of precipitation and, particularly, during Steps (1) and/or (2) of the method of the invention is particularly contemplated. The inclusion of ripening agents in the dispersing medium is contemplated, as illustrated by *Research Disclosure,* Item 38957, I. Emulsion grains and their preparation, E. Blends, layers and performance categories, paragraph (2).

Following precipitation the emulsions can be further prepared for photographic use in any conventional photographic manner, including sensitization, addenda addition, coating, exposure and photographic processing. The following teachings of *Research Disclosure,* Item 38957, are illustrative:

III. Emulsion washing
IV. Chemical sensitization
V. Spectral sensitization and desensitization
VII. Antifoggant and stabilizers
II. Vehicles, vehicle extenders, vehicle-like addenda and vehicle related addenda (these components being those that are typically added after precipitation, but before coating)
B. Hardeners
C. Other vehicle components
VIII. Absorbing and scattering materials
IX. Coating physical property modifying addenda
X. Dye image formers and modifiers
XI. Layers and layer arrangements
XII. Features applicable only to color negative
XIII. Features applicable only to color positive
B. Color reversal (employing negative-working emulsions as contemplated by the method of the invention)
XIV. Scan facilitating features
XV. Supports
XVI. Exposure
XVIII. Chemical development systems
XIX. Development
XX. Desilvering, washing, rinsing and stabilizing.

EXAMPLES

The invention can be better appreciated by reference to the following specific embodiments.

Host Tabular Grain Emulsion Preparation

A stirred reaction vessel containing ca. 5104 g distilled water, ca.10 g of bone gelatin, ca. 30.9 g of sodium bromide, and ca. 72.25 g of ammonium sulfate was heated to 58° C. Aqueous solutions of ca. 3.3 M silver nitrate and ca. 3.5 M sodium bromide were then added by a conventional controlled double-jet addition process at a constant silver nitrate flow rate of ca. 35 mL/min for ca. 1.25 min while maintaining pAg constant at ca. 9.52. Then the silver nitrate and the sodium bromide salt solution flows were stopped and the mixture was held for 1 min. Next, ca. 124 mL of 2.5 M sodium hydroxide solution was rapidly added to the reaction vessel, and the stirred mixture was held for an additional 5 min. This was followed by rapid addition of ca 78 mL of 4 M nitric acid solution to the reaction mixture. Then a mixture containing ca. 180 g of bone gelatin, and ca. 1728 g distilled water was rapidly added to the reaction vessel, and the contents were held with stirring for ca. 5 min. The resultant emulsion grains were then grown for the next 5 min. by conventional double-jet process by adding ca. 3.3 M silver nitrate solution at a constant flow rate of ca. 25 mL/min and a mixed salt solution containing ca. 3.4 M sodium bromide and ca.0.05 M potassium iodide, at a flow rate such that pAg was controlled at ca. 9.33. The growth was then accelerated by linearly ramping the silver nitrate solution flow rate from ca. 25 mL/min to ca. 100 mL/min over 56 min while controlling pAg at ca. 9.33 with the above mixed salt solution. The next growth step was carried out by adding the above silver nitrate solution at a constant flow rate of ca. 100 mL/min over 1.5 min while adding the above mixed salt solution and ca. 52 mL of a solution containing ca. 15 mL of a stock solution of potassium hexachloroiridate containing 0.04 mg of the iridate compound perl.5 mL of 1.51 molar $HNO_3$ and ca. 36 mL of water, at a rate that controlled the pAg at ca. 9.33. This was followed by rapid addition of ca. 258 mL of a solution containing ca. 73 mL of water containing 34 mg of potassium salt of selenocyanic acid and ca. 185 ml of water and holding the mixture for ca. 2 min while stirring. Next, the pAg of the reaction mixture was changed by adding the above mixed salt solution at ca. 250 mL/min for 2 min, followed immediately by rapid addition of ca. 0.46 mole of a fine (0.06 $\mu$m) grained silver iodide emulsion.

Emulsion A (comparison)

A 3.3 M silver nitrate solution was then added to the Host Tabular Grain emulsion as a single jet at a constant flow rate of ca. 51 mL/min for ca. 13.25 min. Then the emulsion was grown further by conventional balanced double jet process by adding ca. 51 mL/min of ca. 3.3 M silver nitrate and ca. 3.5 M sodium bromide solutions over ca. 11.4 min such that pAg was maintained at ca. 8.38. The emulsion was then cooled and washed.

The resultant tabular grain emulsion had a mean ECD of ca. 1.98 $\mu$m and a mean tabular grain thickness of ca. 0.13 $\mu$m. Tabular grains accounted for greater than 70 percent of total grain projected area.

Emulsion B (example)

A 3.3 M silver nitrate solution was then added to the Host Tabular grain emulsion as eight single jet pulses, each consisting of a constant silver nitrate solution flow rate of ca. 241 mL/min, followed by eight hold intervals. The duration of single jet pulses was ca. 0.5, 0.5, 0.5, 0.4, 0.4, 0.25, 0.25, and 0.2 min, respectively. Each pulsed addition was followed by a 5 min period of hold. The emulsion was then grown further by addition of 3.3 M silver nitrate and 3.5 M sodium bromide salt solutions as seven double jet pulses, each pulse followed by a hold interval. The duration of the double jet pulses and the hold intervals were as follows:

| event | minutes |
|---|---|
| pulse 1 | 0.25 |
| interval | 5 |
| pulse 2 | 0.25 |
| interval | 5 |
| pulse 3 | 0.25 |
| interval | 5 |
| pulse 4 | 0.4 |
| interval | 10 |
| pulse 5 | 0.4 |
| interval | 5 |
| pulse 6 | 0.4 |
| interval | 5 |
| pulse 7 | 0.4 |
| interval | 10 |

The emulsion was then cooled and washed.

The resultant tabular grain emulsion had a mean ECD of ca. 2.05 $\mu$m and a mean tabular grain thickness of ca. 0.13 $\mu$m. Tabular grains accounted for greater than 70 percent of total grain projected area.

Photographic Elements

Emulsions A and B were optimally sulfur and gold sensitized, spectrally sensitized with BSD-1, and separately coated in Layer 10 of otherwise identical photographic elements. The layers are numbered, starting with the layer nearest the cellulose triacetate film support. Coating coverages are given in g/m$^2$, except as otherwise stated. Components are in part identified by acronyms, with a correlation of acronyms and complete names appearing below.

Layer 1 (Antihalation layer): black colloidal silver sol at 0.172; ILS-1 at 0.135, DYE-1 at 0.031; DYE-5 at 0.028; DYE-6 at 0.025; ADD-1 at 0.001; ADD-2 at 0.110; ADD-3 at 0.055; ADD4 at 0.915; ADD-5 at 0.213; and gelatin at 2.05.

Layer 2 (Slow cyan layer): a blend of two red sensitized (both with a mixture of RSD-1 and RSD-2) tabular grain silver iodobromide emulsions: (i) ECD 1.0 μm, th 0.09 μm, 4.1 mole % I at 0.323 (ii) ECD 0.55 μm, th 0.08 μm, 1.5 mole % I at 0.431; cyan dye-forming coupler C-1 at 0.535; bleach accelerator releasing coupler B-1 at 0.031; masking coupler MC-1 at 0.03; ADD-6 at 1.8 g/mol silver and gelatin at 2.024.

Layer 3 (Mid cyan layer): a red sensitized (a mixture of RSD-1 and RSD-2) tabular grain silver iodobromide emulsion: ECD 1.25 μm, th 0.12 μm, 4.1 mole % I at 0.883; cyan coupler C-1 at 0.105; DIR-1 at 0.093; MC-1 at 0.018; ADD-6 at 1.8 g/mol silver and gelatin at 1.012.

Layer 4 (Fast cyan layer): a red sensitized (a mixture of RSD-1 and RSD-2) tabular grain silver iodobromide emulsion: ECD 2.2 μm, th 0.13 μm, 4.1 mole % I at 1.076; C-1 at 0.120; DIR-1 at 0.019; MC-1 at 0.032; ADD-6 at 1.8 g/mol silver; ADD-7 at 0.05 mg/mol silver and gelatin at 1.270.

Layer 5 (Interlayer): LS-1 at 0.075; ADD-9 at 0.002; ADD-8 at 0.001; SURF-1 at 0.021; SURF-2 at 0.009 and gelatin at 0.700.

Layer 6 (Slow magenta layer): a blend of two green sensitized (both with a mixture of GSD-1 and GSD-2) silver iodobromide tabular grain emulsions: (i) ECD 1.0 μm, th 0.08 μm, 4.1 mole % iodide at 0.0.237 and (ii) ECD 0.55 μm, th 0.08 μm, 1.5 mole % iodide at 0.431; magenta dye forming coupler M-1 at 0.299; MC-2 at 0.041; ADD-6 at 1.8 g/mol silver; ADD-1 at 64 mg/mol silver; OxDS-1 at 2.8 g/mole silver; and gelatin at 1.27.

Layer 7 (Mid magenta layer): a green sensitized (a mixture of GSD-1 and GSD-2) silver iodobromide tabular grain emulsion: ECD 1.2 μm, th 0.12 μm, 4.1 mole % I at 1.00; M-1 at 0.82; MC-2 at 0.032; DIR-8 at 0.024; OxDS-1 at 0.045; ADD-6 at 1.8g/mol silver; ADD-7 at 0.05 mg/mol silver; and gelatin at 1.465.

Layer 8 (Fast magenta layer): a green sensitized tabular grain silver iodobromide emulsion: ECD 2.2 μm, th 0.13 μm, 4.1 mole % I at 1.044; M-1 at 0.057; MC-2 at 0.043; DIR-2 at 0.011; DIR-7 at 0.011; OxDS-1 at 0.031; ADD-6 at 1.8 g/mol silver; ADD-7 at 0.1 mg/mol silver and gelatin at 1.251.

Layer 9 (Yellow filter layer): yellow filter dye YFD-1 at 0.161; ILS-1 at 0.075; ADD-9 at 0.002; ADD-8 at 0.001; SURF-1 at 0.021; SURF-2 at 0.009 and gelatin at 0.648.

Layer 10 (Yellow layer): Emulsion A or Emulsion B at 1.075; yellow dye forming coupler Y-1 at 1.044; DIR-3 at 0.076; B-1 at 0.022; ADD-6 at 1.8 g/mol silver and gelatin at 1.879.

Layer 11 (UV filter layer): silver bromide Lippmann emulsion at 0.216; UV-1 at a total of 0.108; $MnSO_4$ at 0.08; gelatin at 1.242 and bis(vinylsulfonyl) methane hardener at 1.75% by weight of total gelatin weight (all layers).

Layer 12 (Protective overcoat) To physically protect the emulsion layers a conventional protective overcoat containing gelatin at 0.888, matte beads and surface property modifying addenda was provided.

Sensitometry

Samples of each of the photographic elements were identically exposed through a step tablet and processed in the Kodak Flexicolor™ C41 color negative process described in *British Journal of Photography Annual,* 1988, pp. 196–108. Speed was measured at a density of 0.15 above minimum density and is reported as relative speed, with the element containing Emulsion A, being assigned a relative speed of 100. The granularities of the elements containing Emulsions A and B were identical.

The performance of the photographic elements containing Emulsions A and B is compared in Table I.

TABLE I

| Emulsion | Relative Speed |
|---|---|
| A | 100 |
| B | 117 |

Reversal Imaging

Emulsions A and B were coated as separate blue recording, yellow dye image forming emulsion layers on cellulose triacetate film support. Silver coating coverages were 0.75 g/m$^2$. Following exposure through a step tablet, samples of the coatings received color reversal processing in the Kodak Ektachrome™ E-6 color reversal process.

Assigning a relative speed of 100 to the Emulsion A (comparative) element, the Emulsion B (example) element exhibited a relative speed of 250. Further, from granularity comparisons, the granularity of the image produced by Emulsion B was significantly lower than the granularity of the image produced by Emulsion A.

Robustness

To compare the robustness of Emulsions A and B, samples of these emulsions were sulfur and gold sensitized at varied elevated hold temperatures. Each emulsion was assigned a relative speed of 100 at 64° C. to allow comparisons with its performance at other elevated hold temperatures.

The results are summarized in Table II.

TABLE II

| | Relative Speed | | | |
|---|---|---|---|---|
| Emulsion | 58° C. | 61° C. | 64° C. | Variance |
| A | 25 | 50 | 100 | 75 |
| B | 87 | 100 | 100 | 13 |

From Table II it is apparent that Emulsion A exhibited a wide variance in its speed as a function of the temperature of chemical sensitization. By comparison Emulsion B showed little or no variance, depending upon the temperatures compared. Over the 3° C. temperature range of from 61° C. to 64° C., Emulsion B exhibited no variance in its relative speed as a function of the holding temperature employed during chemical sensitization. When the holding temperature was lowered an additional 3° C. to 58° C., only a comparatively small reduction in relative speed was observed.

This demonstrated that Emulsion B exhibited the capability of undergoing inadvertent preparation variations in chemical sensitization temperatures with little, if any, variance in photographic performance.

Intrinsic Fog

The intrinsic fog levels of Emulsions A and B were compared by adding to equal silver weight samples of these emulsions 10 micromoles of gold per silver mole. The mixture was heated to 66° C., held for 5 minutes, and cooled to 40° C.

The intrinsic fog level was measured by coating the emulsions at a silver coverage of 4.3 g/m$^2$ with hardener added on a clear plastic support. Without exposure the elements containing Emulsions A and B were given conventional black-and-white photographic processing employing a mixture of hydroquinone and N,N-dimethyl-p-aminophenol hemisulfate developing agents.

The intrinsic fog level of the photographic element containing Emulsion B, prepared by the method of the invention was one third that of the photographic element containing comparative Emulsion A.

Component Listing

DYE-1

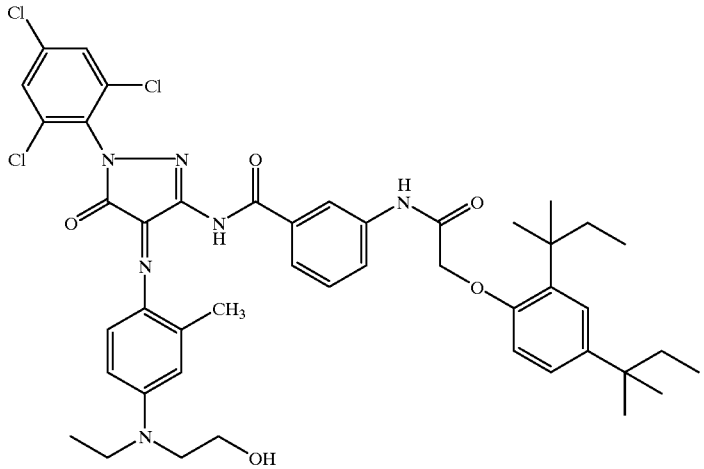

DYE-5

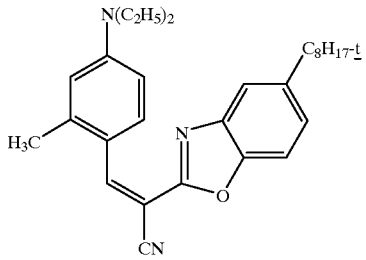

DYE-6

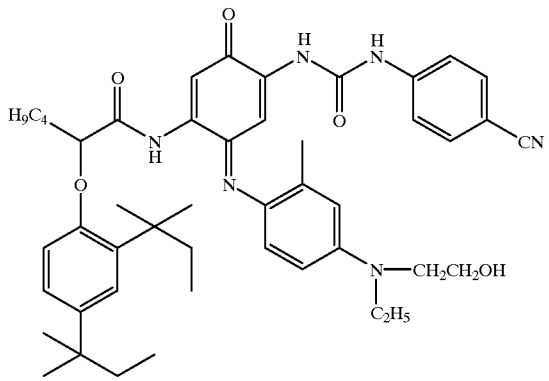

UV-1:

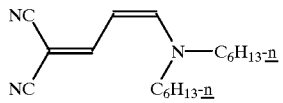

-continued
| Component Listing |
|---|
| UV-2: 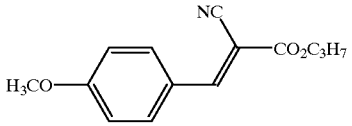 |
| C-1: 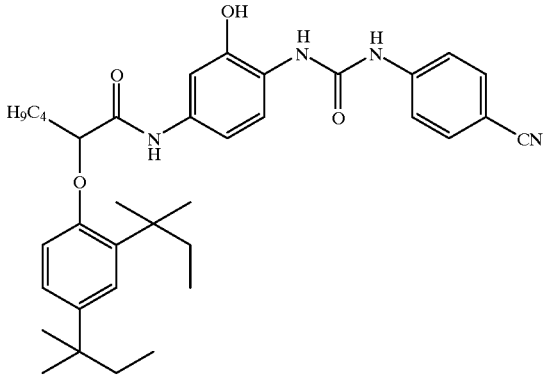 |
| M-1: 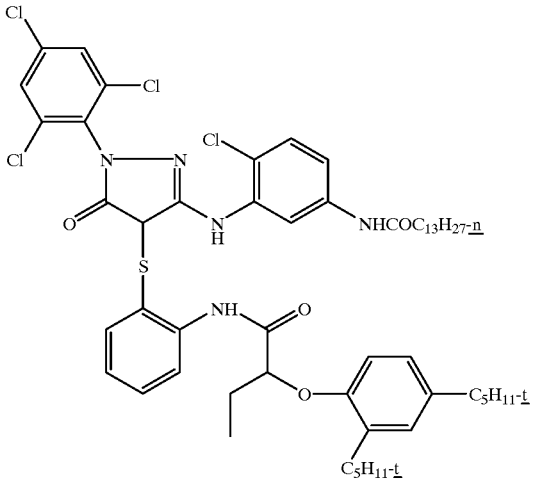 |
| Y-1: 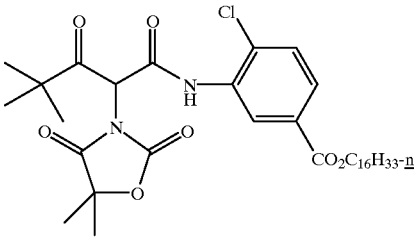 |
| B-1: 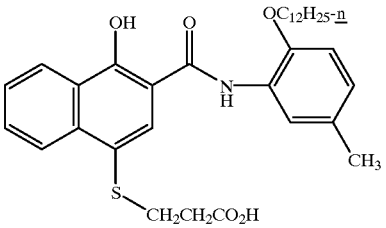 |

-continued
| Component Listing |
|---|
| MC-1: 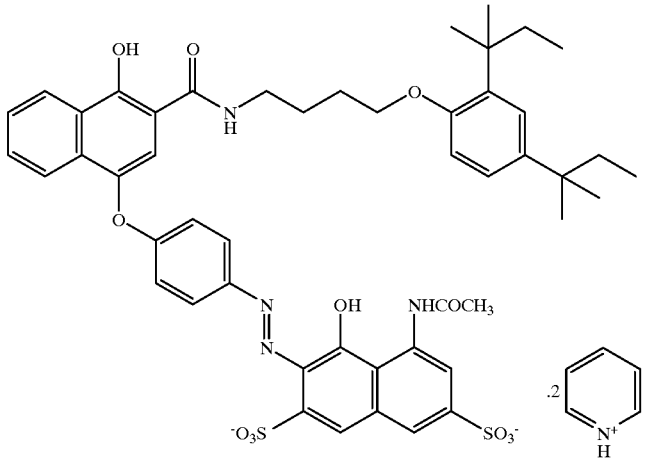 |
| MC-2: 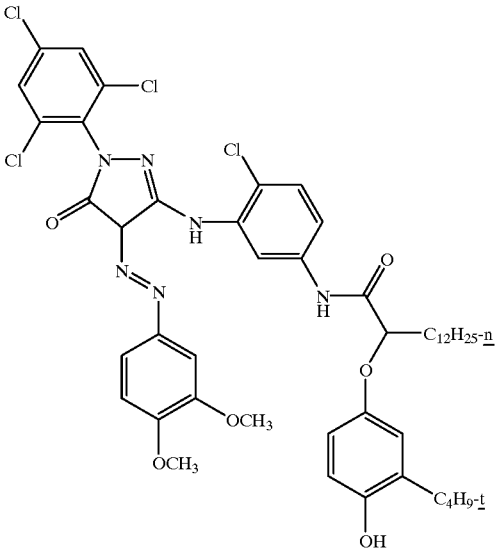 |
| DIR-1: 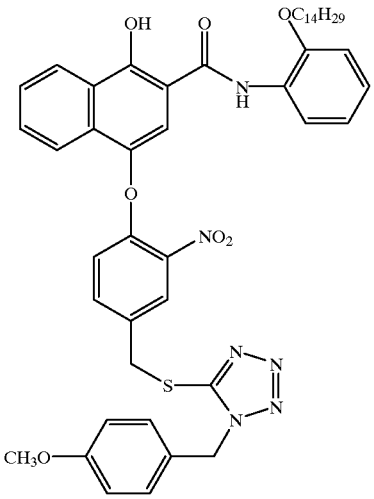 |

-continued
| Component Listing |
| --- |
| DIR-2: 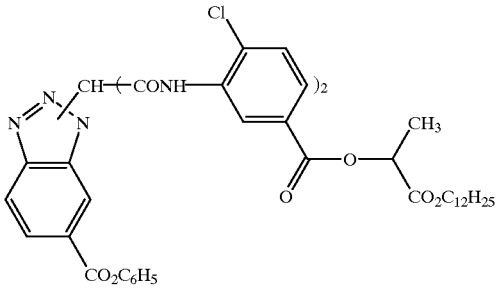 |
| DIR-3: 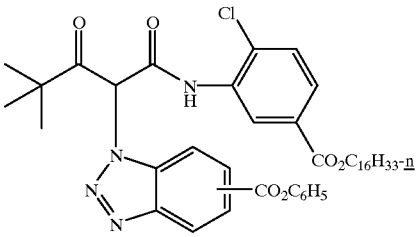 |
| DIR-7: 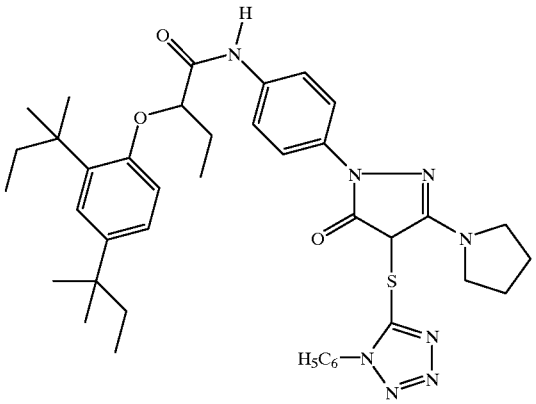 |
| DIR-8 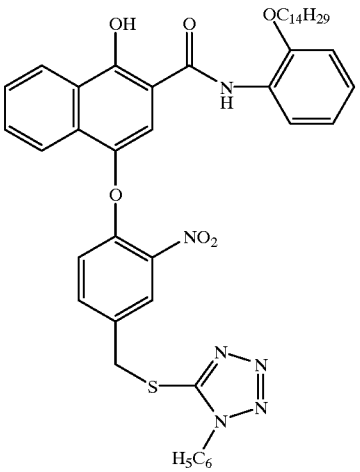 |

-continued
| Component Listing |
|---|
| ILS-1: 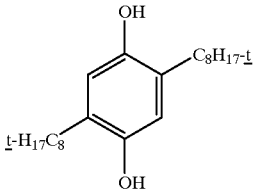 |
| OxDS-1: 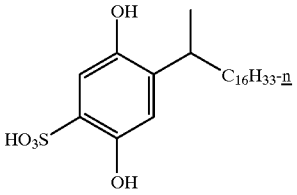 |
| YFD-1: 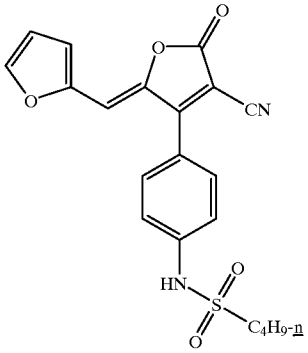 |
| RSD-1: 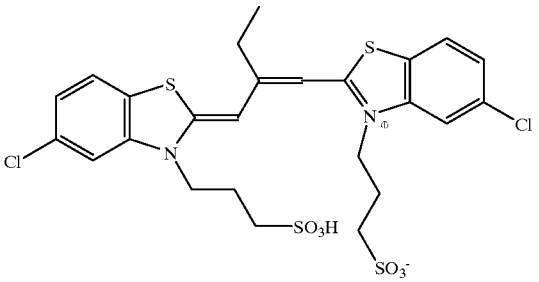 |
| RSD-2: 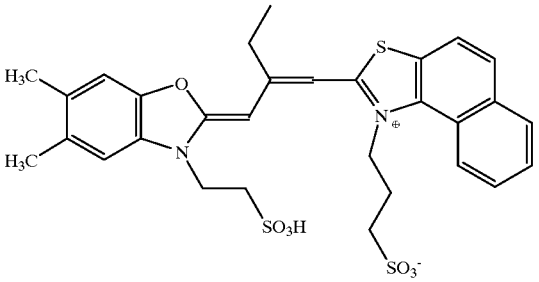 |

-continued

Component Listing

GSD-1:

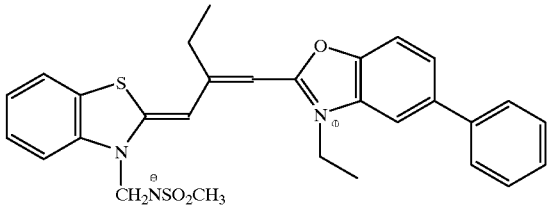

GSD-2:

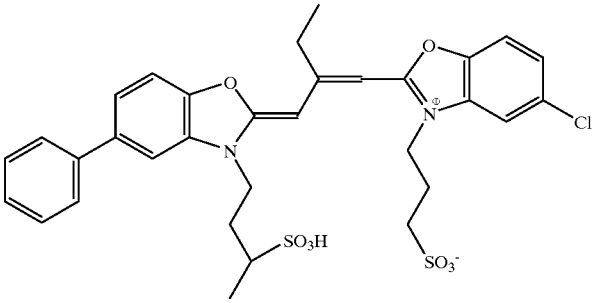

BSD-1:

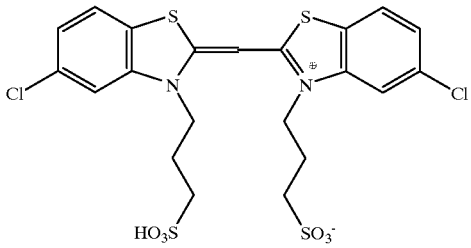

ADD-1

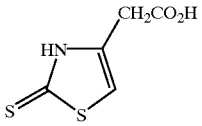

ADD-2

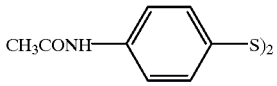

| | |
|---|---|
| ADD-3 | Sodium Hexametaphosphate |
| ADD-4 | 3,5-Disulfocatechol, di-sodium salt |
| ADD-6 | 4-Hydroxy-6-methyl-1,3,3a,7-tetrazaindene |
| ADD-7 | $Au_2S$ |
| ADD-8 | $MnSO_4$ |
| ADD-9 | $PdCl_2$ |
| SURF-1 | Triton X-200 ™, available from Union Carbide<br>p-$C_8H_{17}$-ϕ-O-$(CH_2CH_2O)_2$—$CH_2CH_2SO_3^-Na^+$,<br>where ϕ is phenylene |
| SURF-2 | Olin 10-G ™, available from Olin Corp., a mixture of<br>p-$C_9H_{19}$-ϕ-O—$[CH_2CH(CH_2OH)O]_m$—H and<br>p-$C_9H_{19}$-ϕ-O—$[CH_2CHOH(CH_2)O]_m$—H<br>where ϕ is phenylene and m is a mixture of 3 to 16 integers |

SURF-3

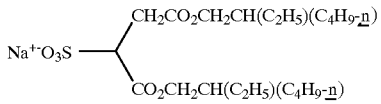

The invention has been described in detail with particular reference to certain preferred embodiments thereof, but it will be understood that variations and modifications can be effected within the spirit and scope of the invention.

PARTS LIST

1 conduit

2 mixing device

3 conduit

4 vessel

6 shaft

7 motor

8 baffles

What is claimed is:

1. A method of manufacturing a radiation-sensitive tabular grain emulsion comprised of (a) providing in a stirred reaction vessel a dispersing medium containing a stoichiometric excess of bromide ions and a host tabular grain emulsion comprising greater than 50 mole percent bromide, based on silver, and a speed enhancing amount of iodide and (b) then precipitating silver bromide onto grains of the host tabular grain emulsion, WHEREIN, in step (b), (1) introducing a silver salt solution into the dispersing medium at a rate sufficient to create a new grain population, (2) halting introduction of the silver salt solution for a time sufficient to allow the new grain population to be dissolved by ripening with silver and bromide ions released from the new grain population being precipitated onto the grains of the host tabular grain emulsion, and (3) repeating steps (1) and (2) from 3 to 20 times until silver bromide deposited onto the grains of the host tabular grain emulsion amounts to from 5 to 50 percent of total silver forming the radiation-sensitive tabular grain emulsion.

2. A method of manufacturing a radiation-sensitive tabular grain emulsion according to claim 1 wherein the tabular grain emulsion formed contains at least 70 mole percent bromide, based on silver.

3. A method of manufacturing a radiation-sensitive tabular grain emulsion according to claim 2 wherein the tabular grain emulsion formed contains at least 90 mole percent bromide, based on silver.

4. A method of manufacturing a radiation-sensitive tabular grain emulsion according to claim 1 wherein the radiation-sensitive tabular grain emulsion formed contains from 0.5 to 10 mole percent iodide, based on silver.

5. A method of manufacturing a radiation-sensitive tabular grain emulsion according to claim 1 wherein the host tabular grain emulsion contains from 70 to 95 of the total silver in the radiation-sensitive tabular grain emulsion formed.

6. A method of manufacturing a radiation-sensitive tabular grain emulsion according to claim 1 wherein Step (1) in each occurrence extends from 5 to 45 seconds.

7. A method of manufacturing a radiation-sensitive tabular grain emulsion according to claim 6 wherein Step (1) in each occurrence extends from 10 to 25 seconds.

8. A method of manufacturing a radiation-sensitive tabular grain emulsion according to claim 1 wherein Step (2) in each occurrence extends over an interval of at least 1 minute.

9. A method of manufacturing a radiation-sensitive tabular grain emulsion according to claim 8 wherein Step (2) in each occurrence extends over an interval of 3 to 15 minutes.

10. A method of manufacturing a radiation-sensitive tabular grain emulsion according to claim 1 wherein in Step (1) the silver salt solution and a bromide salt solution are simultaneously introduced into the dispersing medium at a rate sufficient to create the new grain population and in Step (2) the silver salt solution and the bromide salt solution are simultaneously halted for a time sufficient to allow the new grain population to be dissolved by ripening.

* * * * *